US009103100B2

(12) United States Patent
Harris et al.

(10) Patent No.: US 9,103,100 B2
(45) Date of Patent: Aug. 11, 2015

(54) GRADER BLADE ASSEMBLIES

(71) Applicants: Geoff Harris, Tintenbar (AU); Craig Harris, Tintenbar (AU)

(72) Inventors: Geoff Harris, Tintenbar (AU); Craig Harris, Tintenbar (AU)

( * ) Notice: Subject to any disclaimer, the term of this patent is extended or adjusted under 35 U.S.C. 154(b) by 0 days.

(21) Appl. No.: 14/134,586

(22) Filed: Dec. 19, 2013

(65) Prior Publication Data

US 2014/0338933 A1 Nov. 20, 2014

(30) Foreign Application Priority Data

May 15, 2013 (AU) ..... 2013901711

(51) Int. Cl.
*E02F 3/815* (2006.01)
*E02F 3/76* (2006.01)

(52) U.S. Cl.
CPC ..... *E02F 3/8157* (2013.01); *E02F 3/765* (2013.01); *E02F 3/7645* (2013.01); *E02F 3/7654* (2013.01)

(58) Field of Classification Search
USPC ..... 172/250, 780
IPC ..... E02F 3/8157; A01B 63/02
See application file for complete search history.

(56) References Cited

U.S. PATENT DOCUMENTS

| | | | | |
|---|---|---|---|---|
| 4,074,767 | A * | 2/1978 | Cole | 172/781 |
| 4,084,643 | A * | 4/1978 | Easterling | 172/795 |
| 4,206,818 | A * | 6/1980 | Beckham et al. | 172/781 |
| 5,667,020 | A * | 9/1997 | Palmer et al. | 172/781 |
| 5,720,353 | A * | 2/1998 | Wilkening | 172/795 |
| 7,874,085 | B1 * | 1/2011 | Winter et al. | 37/270 |
| 7,926,583 | B2 * | 4/2011 | Newnam | 172/684.5 |
| 8,316,956 | B2 * | 11/2012 | Horstman et al. | 172/781 |
| 8,464,803 | B2 * | 6/2013 | Greuel et al. | 172/795 |
| 8,869,910 | B2 * | 10/2014 | Greuel et al. | 172/796 |
| 2011/0247845 | A1 * | 10/2011 | Greuel et al. | 172/677 |

* cited by examiner

*Primary Examiner* — Gary Hartmann
(74) *Attorney, Agent, or Firm* — Kirton McConkie; Evan R. Witt

(57) ABSTRACT

A grader blade assembly for mounting a blade to a grader comprises at least one bearing plate which reduces vibration of the blade during use and wherein at least one shim is used to reposition the bearing plate as it is subjected to wear. A grader blade assembly may alternatively or additionally include at least one bearing pad which reduces vibration of the blade during use and wherein at least one shim is used to reposition the bearing pad as it is subjected to wear. The shims are flexible and can conform to the contour of the bearing plate or pad and are of the same shape as the plate or pad with which it is to be used.

6 Claims, 4 Drawing Sheets

GRADER BLADE ASSEMBLIES

FIELD OF INVENTION

This invention relates to grader blades and in particular to the maintenance of the accuracy of their operation.

BACKGROUND OF THE INVENTION

It should be noted that reference to the prior art herein is not to be taken as an acknowledgement that such prior art constitutes common general knowledge in the art.

Graders have been used for many years in construction, mining, farming and road maintenance to displace and level material on the ground such as soil or snow in order to create a smooth, flat surface.

Graders generally comprise a chassis, two or three axles with wheels on which the grader can move and are self-propelled by an engine. Graders typically have a cab which houses the controls for the machine which can be operated by a person inside the cab. In any arrangement a grader will have at least one long blade which is located on the underside of the grader to contact the ground and scrape, clear or grade the surface of the ground. The blade is secured to the grader by a blade assembly which is usually located between two of the axles of the grader. However, the blade assembly may also be located at the very front of the grader, i.e. in front of the front axle.

At least one end of the blade can be lowered and raised so that the blade can be used to create level or angled ground surfaces. In use the blade is set to the desired position and then the grader is propelled forward so that the blade clears and levels the ground material to form a smooth, flat surface according to the angle of the blade. Furthermore, the blade assembly of most graders can also be adjusted within the horizontal plane so that the blade is not perpendicular to the direction of movement but rather advances through the ground material at an angle respective to the direction of movement.

Operation of the blade assemblies of graders typically involves rotational gears which turn the blade to the required angle respective to the direction of movement of the grader and hydraulic rams which lift the blade to the required height and grading angle.

During use, the blade is subject to significant and variable forces as it is moved through the ground material and accordingly, the grader and the blade can shudder and move during use. This is undesirable as it can result in the blade wobbling and moving over the ground creating an uneven surface. Guide blocks and bearing plates have been used to cushion the joints between moving parts of the blade assembly in order to absorb the forces experienced by the assembly during use. The guide blocks and bearing plates thereby remove the wobble and shudder from the assembly and maintain the accuracy of movement and operation of the blade.

However, the forces absorbed by the guide blocks and bearing plates cause them to wear which loosens the contact between the moving parts of the blade assembly. Accordingly, this introduces error to the turning circle and height of the blade resulting in reduced accuracy of adjustment of the blade position and reduced quality of the graded surface. Although the error is relatively small, modern earth moving operations require close accuracy and the guide blocks and bearing plates have to be replaced on a regular basis. This generally is performed by a qualified technician to ensure the location of the new wear pads meet manufacturer's specifications and can result in a full day of operational downtime. Therefore, it is not only time consuming but can be a costly task.

Accordingly, it would be advantageous of the present invention to provide a contrivance which ameliorates the disadvantages set forth above or at least provides an alternative to the prior art.

STATEMENT OF THE INVENTION

According to the present invention, a grader blade assembly for mounting a blade to a grader comprises at least one bearing plate which reduces vibration of the blade during use and wherein at least one shim is used to reposition the bearing plate as it is subjected to wear. Additionally or alternatively, the grader blade assembly also comprises at least one bearing pad which reduces vibration of the blade during use and wherein at least one shim is used to reposition the bearing pad as it is subjected to wear.

Preferably, the shims are flexible and can conform to the curve of a bearing plate or a bearing pad. Even more preferably, the shims are available in the same shape as the bearing plate or bearing pad with which it is to be used.

In a preferred embodiment, the bearing plate or bearing pad and the shims have at least one hole therethrough and the hole in the plate or pad and each shim are aligned such that both can be bolted to the blade assembly in alignment. Preferably, the bearing plate or pad and each shim has two holes, one at either end. Alternatively, the bearing pad has at least one hook which is adapted to clip into a mating groove in the assembly to attach the pad thereto and the shims have at least one hole through which the hook can pass so as to retain the shim between the pad and the assembly. Even more preferably, the bearing pad has two hooks which clip into mating grooves in the assembly and the shim has two aligned holes through which a hook can pass.

In an alternative embodiment, the shims are sprung and can be used to bias bearing plates or pads as they are subjected to wear. Preferably, the shims are sprung to bias towards bearing plate or pad.

Preferably, the shims are made from zinc-anneal. Even more preferably the shims can have a thickness in the range of 0.5-1.2 mm.

Preferably, a method for adjusting a grader blade assembly as described above comprises the steps of: removing the at least one bearing plate or pad from the assembly, placing at least one shim between the bearing plate or pad and the assembly, and reattaching the bearing plate or pad to the assembly securing the shim therebetween.

BRIEF DESCRIPTION OF THE DRAWINGS

For a better understanding of the present invention and to show more clearly how it may be carried into effect reference will now be made, by way of example, to the accompanying drawings in which.

DETAILED DESCRIPTION OF THE INVENTION

Figure 1:
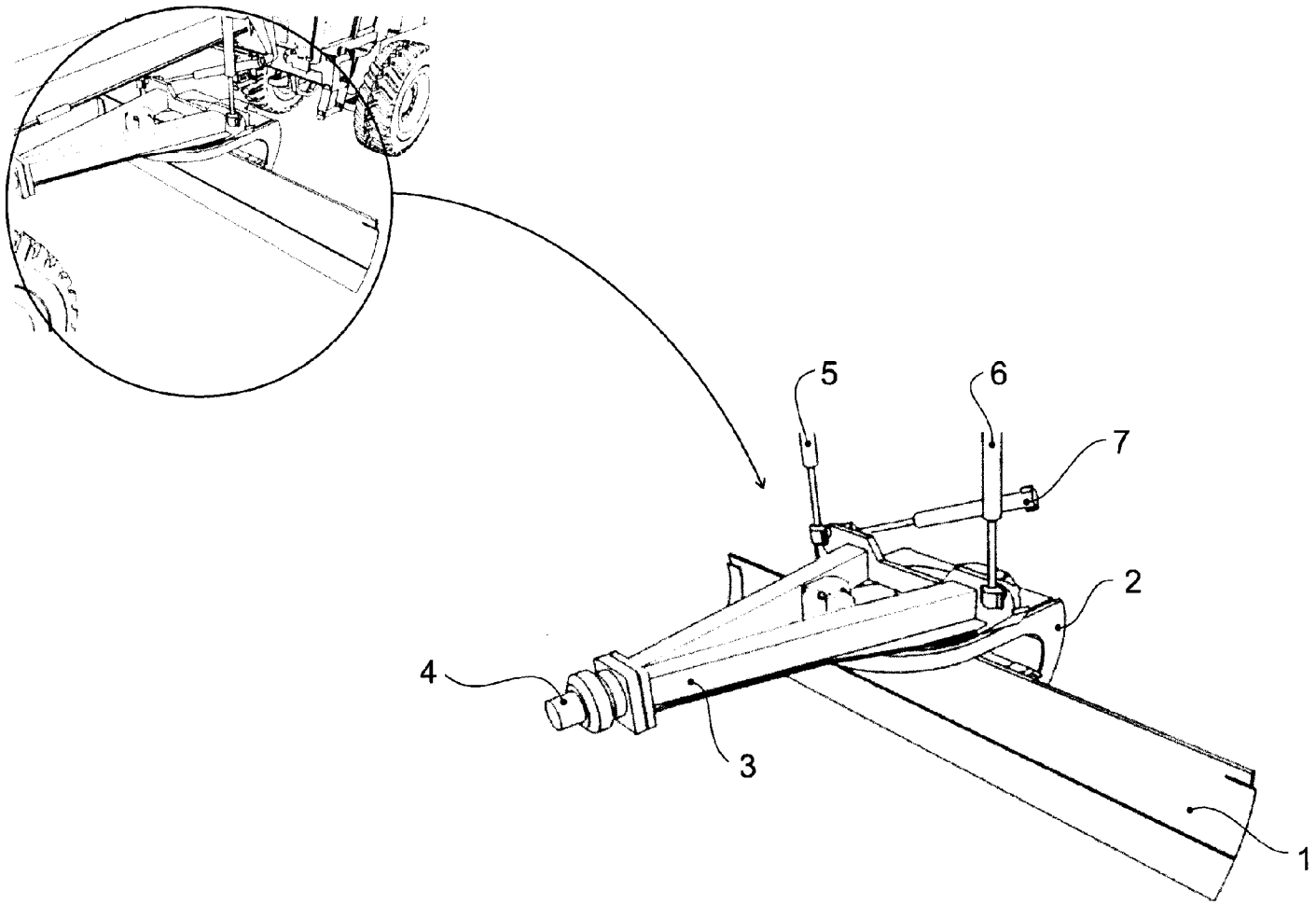
FIG. 1 is a perspective view of the grader blade assembly.

In FIG. 1, blade 1 is attached to mount 2 which is suspended from A frame 3 which in turn is attached to the grader chassis (not shown) by pivotable joint 4. Hydraulic rams 5, 6 and 7 control the height and angle of attack of blade 1.

Figure 2:
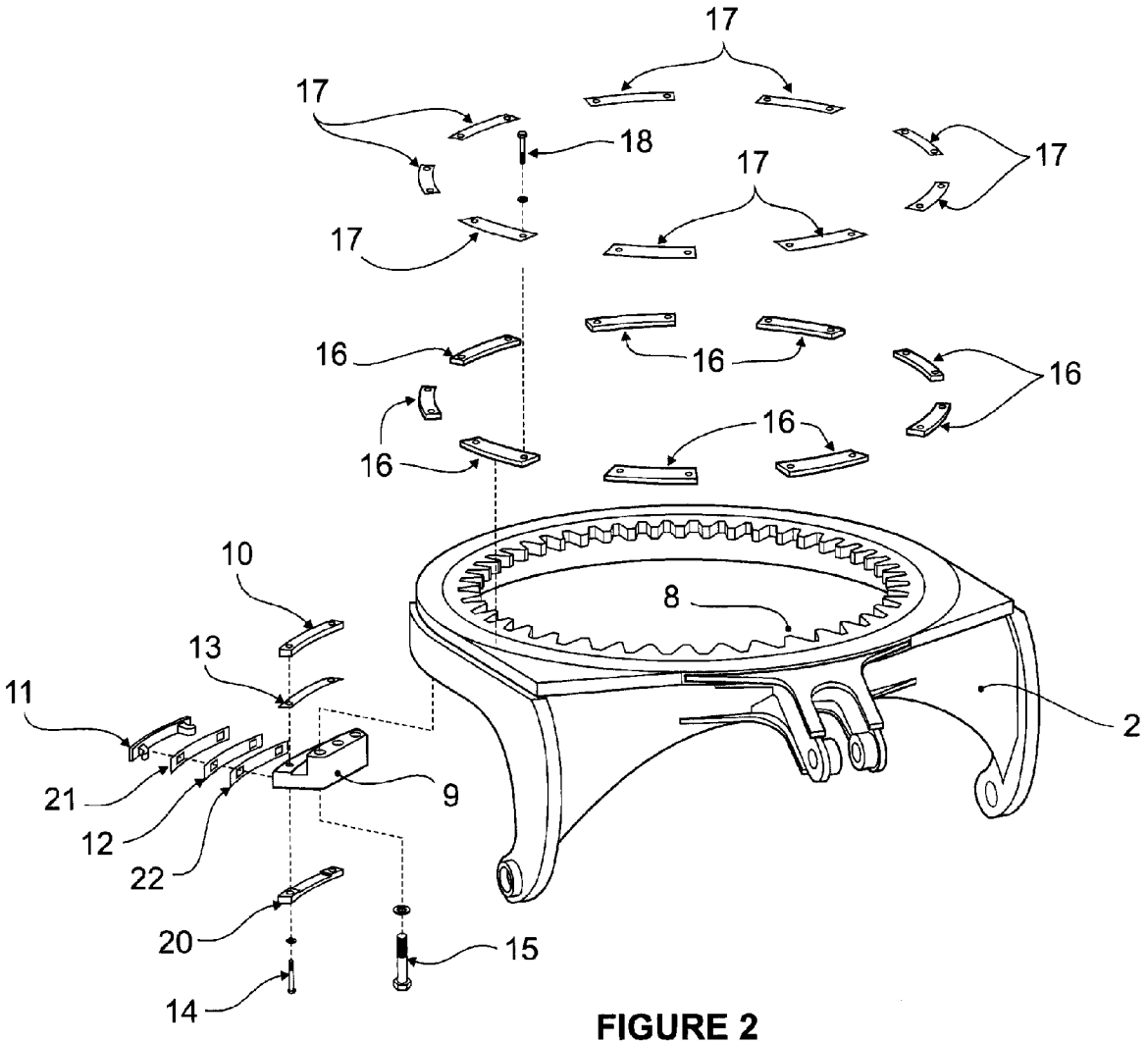
FIG. 2 is an exploded perspective of the blade mount.

FIG. 2 shows mount 2 with circle gear 8, guide block 9, bearing plate 10, retaining plate 20, bearing pad 11, shims 12, 21, 22 and 13, bolts 14 and 15, bearing plates 16, shims 17 and bolt 18. Only one guide block 9 is shown of six located around circle gear 8 but nine bearing plates 16 and shims 17 are shown located around mount 2.

Figure 5:
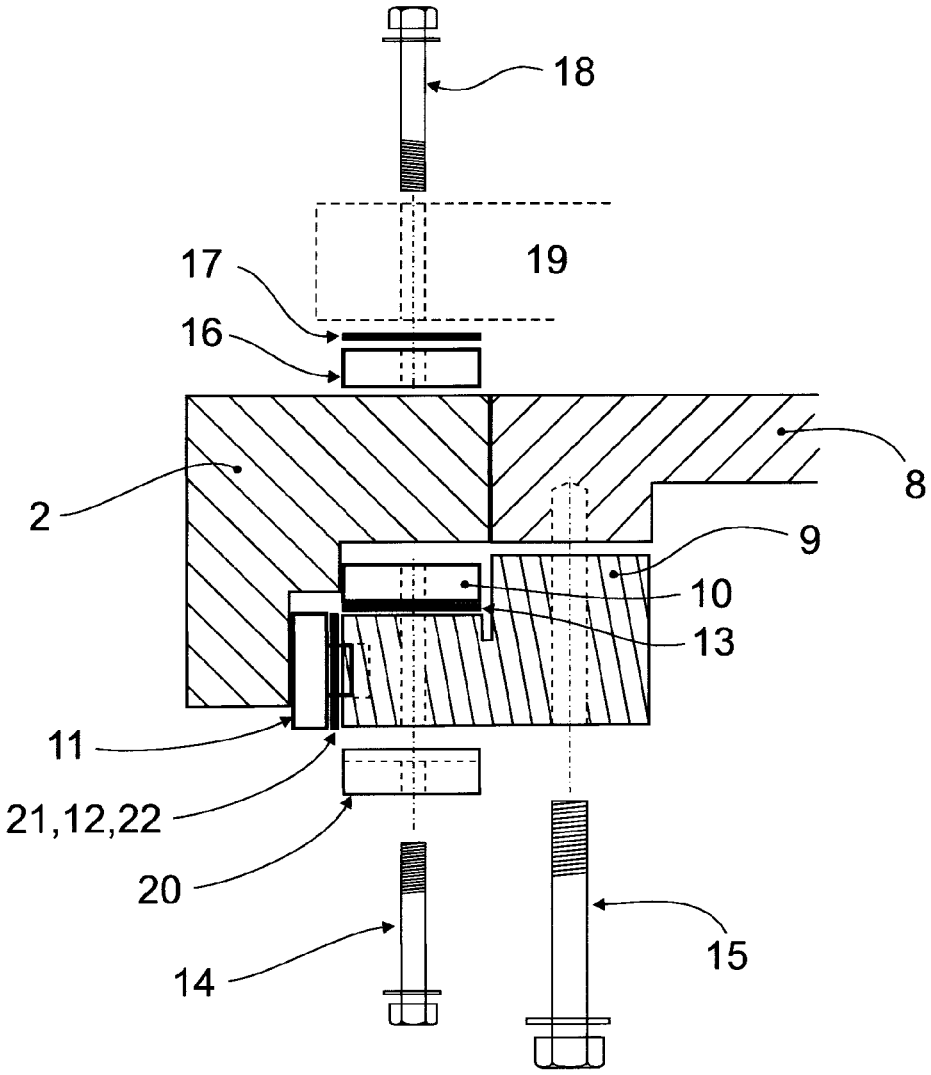
FIG. 5 is a cross section through a guide block of the assembled blade mount.

FIG. 5 is a cross section view of all these components assembled on circle gear 8 and mount 2. Accordingly guide block 9 is bolted to gear 8 by bolt 15 and bearing plate 10, retaining plate 20 and shim 13 are bolted to block 9 by bolt 14. Bearing pad 11 has hooks which clip into a mating groove in block 9 thereby retaining shims 12, 21 and 22 between pad 11 and block 9. Although three shims 12, 21 and 22 are shown, the number used will depend on the amount of adjustment required.

Guide block 9 is secured to circle gear 8 while bearing plate 10 and pad 11 contact the inner surfaces of mount 2. Bolt 18 screws into bearing plate 16 retaining shim 17 between plate 16 and top plate 19. Struts 5 and 6 attach to top plate 19 such that by raising or lowering one or both of the struts the height of the blade can be adjusted.

Cog (not shown) is located within circle gear 8 and has teeth which mate with teeth of gear 8 to drive movement of gear 8. A hydraulic motor (not shown) attaches to cog to drive gear 8 and turn blade 1. When gear 8 moves it is maintained in the correct alignment by guide block 9 and any vibration or wobble is absorbed by bearing plates 10 and 16 and pad 11.

During use, bearing plates 10 and 16 and bearing pad 11 absorb significant shock and accordingly can become subject to wear. As plates 10, 16 and pads 11 wear out, their thickness is altered and the connections between various parts of the assembly become loose. This affects the ability of the blade to be accurately adjusted. This loose connection can be rectified by inserting one or more shims between the bearing plate 10 or 16 or pad 11 and the part to which it is connected. Shims are provided onboard the grader in a toolbox or the like so that a driver can make the adjustment himself. A number of shims of varying thicknesses can be provided to allow for larger or more intricate adjustments as required to maintain the accuracy of the grader and the blade. A typical shim would be 1 mm thick but other thicknesses could include 0.5 mm, 0.7 mm or even 1.2 mm.

To make an adjustment, bearing plate 10 or 16, or pad 11 is removed from the assembly by either unscrewing bolt 14, 15 or 18 or unclipping pad 11 and then placing the required number of shims between the plate or pad and reattaching the plate or pad to the assembly appropriately.

Figure 3:
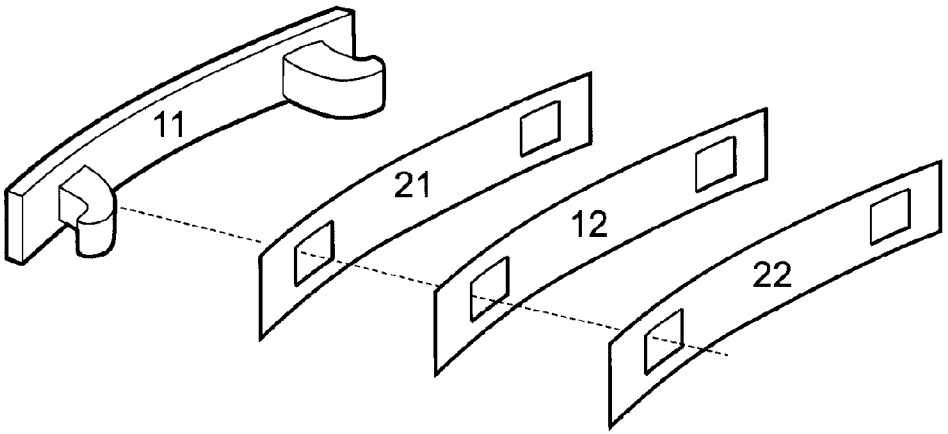
FIG. 3 is a perspective view of a guide block, bearing pad and shims.
Figure 4:
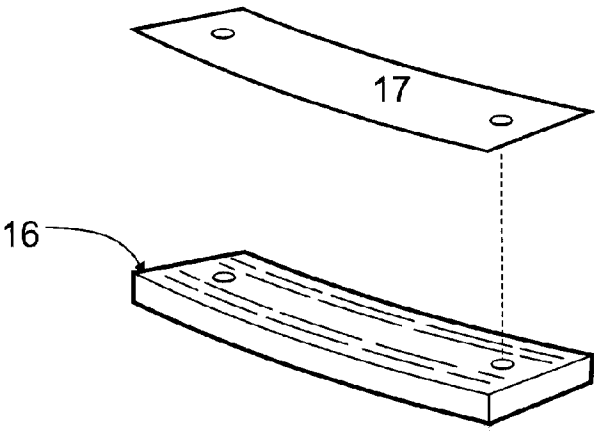
FIG. 4 is a perspective view of a bearing plate and shim.

As shown in FIGS. 3 and 4, shims 12, 13, 17, 21 and 22 are shaped to correspond to the associated bearing plate 16 or bearing pad 11 and have at least one hole which corresponds with holes in plate 16 or hooks in pad 11. Furthermore, shims are also flexible so as to conform to the contour of bearing plate 10 or 16, or pad 11 with which it is used. These features ensure that shims 12, 13, 17, 21 and 22 are evenly aligned with bearing plate 10 or 16, or pad 11 such that the plate or pad is in good connection with the blade assembly. Shims are made from zinc-anneal but can be made from any other suitably durable and non-perishable material.

In an alternative embodiment, shims 12, 13, 17, 21 and 22 are made from sprung zinc-anneal. Therefore as pad 11 and plates 10 and 16 wear, the shims automatically take up the slack. This removes the requirement for the driver to manually add shims to the loose connections and means that the accuracy of the blade is maintained over a longer period of wear before any adjustments need to be made.

It will be obvious that the use of shims 12, 13, 17, 21 and 22 maintain the accuracy of positioning of blade 1 over a longer period of operation and therefore reduce the need for costly maintenance. The shims themselves are inexpensive and can be easily retrofitted to grader blade assemblies.

ADVANTAGES

Previously, when bearing plates 10 or 16 or pad 11 wear and the connections between parts of the blade assembly become loose, an operator would have to have the bearing plates and/or pads replaced completely by a qualified technician to maintain the grader to manufacturer's specifications. This could result in a full day of down time of the grader as well as significant cost in technician fees. Whereas, the present invention gives the driver the ability to adjust the connection of the bearing plate or pad himself without deviating from manufacturer specifications and requires minimal downtime. This not only saves significant operation time but also significant cost and greatly extends the time before bearing plates and pads need to be completely replaced.

VARIATIONS

It will be realized that the foregoing has been given by way of illustrative example only and that all other modifications and variations as would be apparent to persons skilled in the art are deemed to fall within the broad scope and ambit of the invention as herein set forth.

Throughout the description and claims to this specification the word "comprise" and variation of that word such as "comprises" and "comprising" are not intended to exclude other additives components integers or steps.

The drawings herein do not display definitive specifications as they are for explanatory and demonstration purposes only. The dimensions, appearance or materials used in this grader assembly may be varied to suit different graders or different requirements. For example, the number, shape, size and thickness of the shims as well as the location of holes can be varied to work with any type of grader assembly, bearing plate, bearing pad or other cushioning device used in a grader.

The invention claimed is:

1. A grader blade assembly for mounting a blade to a grader comprising:

at least one bearing pad, and optionally at least one bearing plate, for reducing vibration of the blade during use; and at least one shim for repositioning the or each bearing plate or bearing pad or both, wherein the or each shim is flexible and can conform to a curve of the or each bearing plate or the or each bearing pad or both, wherein the or each shim is the same shape as the or each bearing plate or bearing pad or both with which it is to be used, wherein the or each bearing plate or bearing pad or both and the or each shim have at least one hole therethrough wherein the or each hole in the or each bearing plate or bearing pad or both are aligned with the or each hole in the or each shim, such that they can be bolted to the grader blade assembly in alignment, wherein the or each bearing plate or bearing pad or both and the or each shim each have two holes, wherein the or each bearing pad comprises at least one hook which is adapted to clip into mating groove in the grader blade assembly to attach the bearing pad thereto.

2. A grader blade assembly according to claim 1 wherein the at least one shim for repositioning the or each bearing pad comprises at least one hole for passing the hook of the associated bearing pad through for retaining the shim between the bearing pad and the grader blade assembly.

3. A grader blade assembly according to claim 2 wherein the bearing pad comprises two hooks which clip into mating grooves in the grader blade assembly and the shim comprises two aligned holes through which the hooks can pass.

4. A grader blade assembly according to claim 3 wherein the shims are sprung for biasing the or each bearing plate or bearing pad or both, as they are subjected to wear.

5. A grader blade assembly according to claim 4 wherein the or each shim is made from zinc anneal.

6. A grader blade assembly according to claim 5 wherein the or each shim has a thickness in the range of 0.5 to 1.2 mm.

* * * * *